US012760962B2

(12) United States Patent
Gonzalez

(10) Patent No.: US 12,760,962 B2
(45) Date of Patent: Oct. 13, 2026

(54) CHEST FREEZER PLUNGE POWER SAFETY SYSTEM

(71) Applicant: Simon Gonzalez, Miami, FL (US)

(72) Inventor: Simon Gonzalez, Miami, FL (US)

( * ) Notice: Subject to any disclaimer, the term of this patent is extended or adjusted under 35 U.S.C. 154(b) by 218 days.

(21) Appl. No.: 18/928,883

(22) Filed: Oct. 28, 2024

(65) Prior Publication Data

US 2025/0137718 A1 May 1, 2025

Related U.S. Application Data

(60) Provisional application No. 63/545,759, filed on Oct. 26, 2023.

(51) Int. Cl.
*F25D 29/00* (2006.01)
*F25D 23/02* (2006.01)

(52) U.S. Cl.
CPC ..... *F25D 29/006* (2013.01); *F25D 23/026* (2013.01); *F25D 2300/00* (2013.01); *F25D 2700/02* (2013.01)

(58) Field of Classification Search
CPC .. F25D 29/006; F25D 23/026; F25D 2300/00; F25D 2700/02; F25D 23/12; F25D 2400/40
See application file for complete search history.

(56) References Cited

U.S. PATENT DOCUMENTS 3,247,680 A * 4/1966 Winkler ..... F25D 21/002 62/276
4,841,742 A * 6/1989 Biby ..... F25D 3/005 165/122
5,895,981 A * 4/1999 Flegel ..... H02B 1/50 307/64
6,121,897 A * 9/2000 Flegel ..... G08G 1/095 340/693.2
6,624,534 B1 * 9/2003 Flegel ..... H02G 3/00 307/64
2002/0023594 A1 * 2/2002 Greene, Jr. ..... A01K 1/0082 119/496

(Continued)

FOREIGN PATENT DOCUMENTS

CN 205593252 U * 9/2016
CN 207455982 U * 6/2018

(Continued)

*Primary Examiner* — Kun Kai Ma

(74) *Attorney, Agent, or Firm* — Invention To Patent Services; Alex Hobson

(57) ABSTRACT

A chest freezer plunge power safety system is configured to prevent any chance of electrical shock by disconnecting power to the chest freezer when the freezer door is opened. Chest freezers are often filled with water that is chilled by the freezer and used for cold plunge therapy. A person will open the freezer door and submerge their body or portion of their body in the cold water. One or more sensors are configured to detect when the freezer door is opened. The sensor or sensors are coupled with a contactor that disconnects power from a power source to the chest freezer. The sensor element may be attached to the freezer door and configured to be detected by the sensor when the freezer door is in a closed position. The sensor may be coupled with a controller that controls the function of the contactor to open or close the circuit.

20 Claims, 6 Drawing Sheets

(56) References Cited

U.S. PATENT DOCUMENTS

| | | | | |
|---|---|---|---|---|
| 2012/0174607 | A1* | 7/2012 | Cur | F25B 25/00 62/132 |
| 2014/0183977 | A1* | 7/2014 | Braunstein | H02G 3/00 307/147 |
| 2017/0067682 | A1* | 3/2017 | Spinks | H02S 10/40 |
| 2019/0128596 | A1* | 5/2019 | Gmeinder | G01D 5/142 |

FOREIGN PATENT DOCUMENTS

| | | | | | |
|---|---|---|---|---|---|
| CN | 108826811 | A | * | 11/2018 | F25D 23/028 |
| CN | 113494829 | A | * | 10/2021 | F25D 23/028 |
| CN | 114104520 | A | * | 3/2022 | B65D 85/30 |
| CN | 114568888 | B | * | 9/2023 | A47F 3/0404 |
| DE | 102015006623 | A1 | * | 9/2016 | F25D 23/026 |
| FR | 3105822 | A1 | * | 7/2021 | F25D 29/00 |
| JP | 2005003320 | A | * | 1/2005 | |

* cited by examiner

CHEST FREEZER PLUNGE POWER SAFETY SYSTEM

CROSS REFERENCE TO RELATED APPLICATIONS

This application claims the benefit of priority to U.S. provisional patent No. 63/545,759, filed on Oct. 26, 2023; the entirety of both provisional applications are hereby incorporated by reference herein.

BACKGROUND OF THE INVENTION

Field of the Invention

The invention relates to a chest freezer plunge power safety system that is configured to disconnect power to a power output and a chest freezer coupled to the power output when the freezer door of the chest freezer is opened, to prevent any electrical shock when using the chest freezer as a cold plunge bath.

Background

Many people are using chest freezer as cold plunge baths and utilize the refrigeration system of the chest freezer to keep water retained within the freezer receptacle cold. The freezer door is opened and people submerge a portion of their bodies into the chest freezer. There is a risk of electrical shock when using the chest freezer for this purpose as this is not the intended purpose and the chest freezer is not typically utilized to retain large quantities of liquid water for cold plunge purposes.

SUMMARY OF THE INVENTION

The invention is directed to a chest freezer plunge power safety system that is configured to prevent any chance of electrical shock by disconnecting power to the freezer when the freezer door is opened. Chest freezers are often used for cold plunge therapy, that includes submerging a person's body or portion of the body into cold water. Water is poured into the chest freezer and the water is chilled by a refrigeration system to a desired cold temperature, such as about 25° C. or less, about 20° C. or less, about 15° C. or less, about 10° C. or less, about 5° C. or less, about 0° C. or more and any range between and including the values provided.

Chest freezers are configured with a freezer door that extends over a top opening and this door is configured to open to allow a person to enter the cold water within the interior of the chest freezer. One or more sensors are configured to detect when the freezer door is opened. The sensor or sensors are coupled with a contactor that disconnects power from a power source to the chest freezer. A single sensor may be used or a plurality of sensor may be used to ensure safety, whereby if one of a plurality of sensors does not detect the sensor element, power is disconnected to prevent electrical shock. Also, a chest freezer plunge power safety system may employ two or more sensor elements and one or more sensors may be required to detect each of the sensor elements to enable power connection to the power output through the contactor. In this way, there is no risk of electrical shock when the door is opened for entry. The freezer door may have a sensor element, such as a magnet that is detected by the sensor. The sensor element may be attached to the freezer door and configured to be detected by the sensor when the freezer door is in a closed position. The sensor may be coupled with a controller that controls the function of the contactor to open or close the circuit.

An exemplary power supply safety system is configured within a container and a power supply from a power source, such as a power cord plugged into a wall outlet may be coupled to a power input to the power supply safety system. The contactor may receive power from the power input and have contactor switch that in a closed position provides power to the power output and in an open position shuts off and disconnects power to the power output. The sensor is coupled with the contactor, such as through a controller to provide a sensor input regarding the sensor element being detected. Again, when the sensor detects that the sensor element is present, the power is provided to the power output to enable the refrigeration system to operate to cool the water in the freezer receptacle. Then, when the sensor detects that the sensor element is not present, a sensor signal is provided, such as to the controller, and the controller open the contactor circuit to disconnect power to the power output.

A power input may be an electrical receptacle and this electrical receptacle may be within the power system container or outside of the power system container. In an exemplary embodiment, the power input is an electrical receptacle that is configured on an exposed surface of the power system container, whereby the power cord from a power source can be plugged into the electrical receptacle without opening the power system container.

A power output may be an electrical receptacle and this electrical receptacle may be within the power system container or outside of the power system container. In an exemplary embodiment, the power output in an electrical receptacle that is configured on an exposed surface of the power system container, whereby the power cord for the chest freezer can be plugged into the electrical receptacle without opening the power system container.

A power source is configured to provide power to the power supply safety system through an input power cable that is plugged into the power input. The input power cable may be coupled to an outlet. A power source may be municipal power delivered to the power outlet, battery power, solar power, and the like. A battery or solar power system may have an input power cable extending directly from the power source.

A chest freezer may have a freezer interior, or freezer receptacle that contains water that is cooled by the chest freezer. The liquid water may be chilled by contact with the freezer interior. The walls of the A chest freezer as used herein is a freezer that has a top opening and a freezer door that covers this top opening; wherein the freezer door may hinge open or slide open or otherwise be removable or adjustable over the top opening to allow entry of a person into the freezer receptacle.

As used herein, a contactor is an electrically controlled switch used for switching an electrical power circuit. A contactor is typically controlled by a circuit which has a much lower power level than the switched circuit, such as a 24-volt coil electromagnet controlling a 230-volt motor switch.

The summary of the invention is provided as a general introduction to some of the embodiments of the invention and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
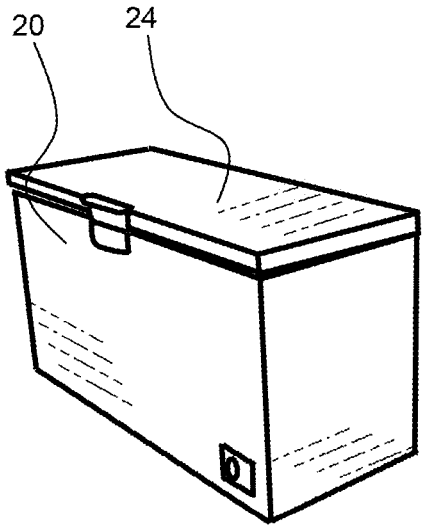
FIG. 1 shows a perspective view of a chest freezer that is configured as a plunge bath.

Corresponding reference characters indicate corresponding parts throughout the several views of the figures. The figures represent an illustration of some of the embodiments of the present invention and are not to be construed as limiting the scope of the invention in any manner. Some of the figures may not show all of the features and components of the invention for ease of illustration, but it is to be understood that where possible, features and components from one figure may be an included in the other figures. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations, and improvements of the described embodiments, will occur to those skilled in the art and all such alternate embodiments, combinations, modifications, improvements are within the scope of the present invention.

Figure 2:
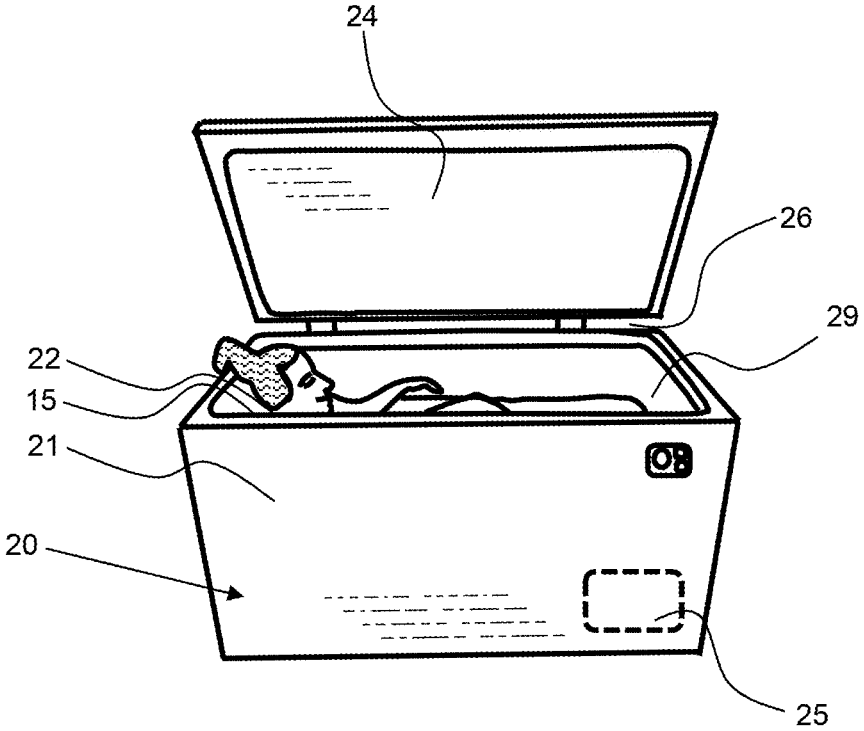
FIG. 2 shows a front perspective view of a chest freezer having a person submerged in the chest freezer and with the freezer door open.

Referring now to FIGS. 1 and 2, a chest freezer 20 is configured as a plunge bath 21. The chest freezer has a freezer interior 22 or freezer receptacle 29 that is large enough for a person to submerge in cold water 15 contained within the freezer interior 22 and cooled by the chest freezer refrigeration system 25. As shown in FIG. 2, a person is submerged in cold water contained within the freezer interior 22. The freezer door 24 is opened and pivots about the freezer door hinge 26 to enable the person to enter the freezer receptacle 29 or freezer interior 22.

Referring now to FIGS. 3 to 6, a chest freezer plunge power safety system 10 is coupled to the freezer exterior 23 by safety systems supports 45, 45'. The power system container 50 is coupled to the freezer and has a sensor or sensors 64, 64' configured to detect one or more sensor elements 42, such as magnets 40, 40' coupled to the freezer door 24, such that when the freezer door is opened, the sensor detects that the door is opened, as the magnet is moved from proximity to the sensor (shown in FIG. 8). It should be noted that a single sensor may be configured to require the detection of two or more sensor elements, such as magnets to enable power to be connected to the power output.

Figure 3:
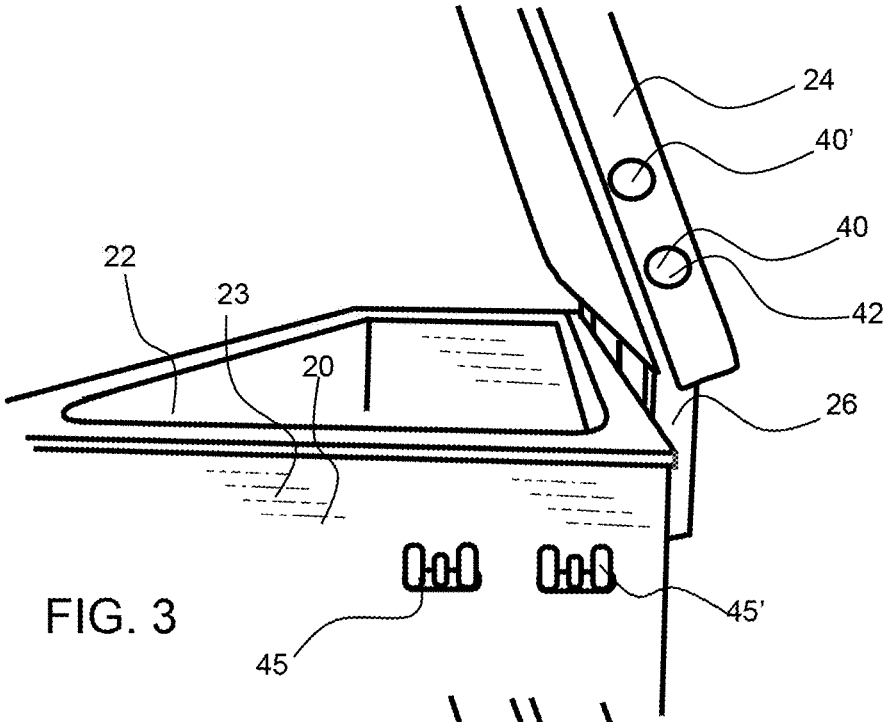
FIG. 3 shows an end of a chest freezer having a power safety system support and a magnet.

As shown in FIG. 3, the freezer door 24 is opened about the freezer door hinge 26. Also, the safety systems supports 45, 45' are configured to receive the power system container 50. The power system container may be detachably attached to the chest freezer 20.

Figure 4:
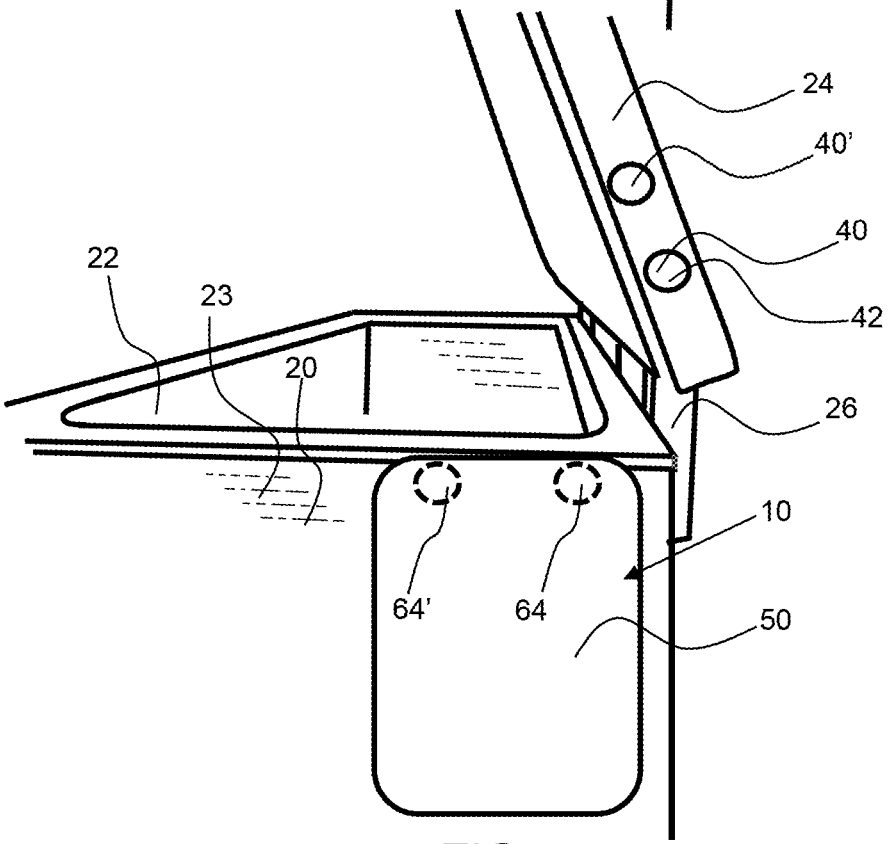
FIG. 4 shows an end of a chest freezer having a chest freezer plunge power safety system coupled to the chest freezer and with the freezer door open.

As shown in FIG. 4, a chest freezer 20 has a chest freezer plunge power safety system 10 coupled to the chest freezer, and configured within a power system container 50 having a container cover 51 to allow access into the interior of the container.

Figure 5:
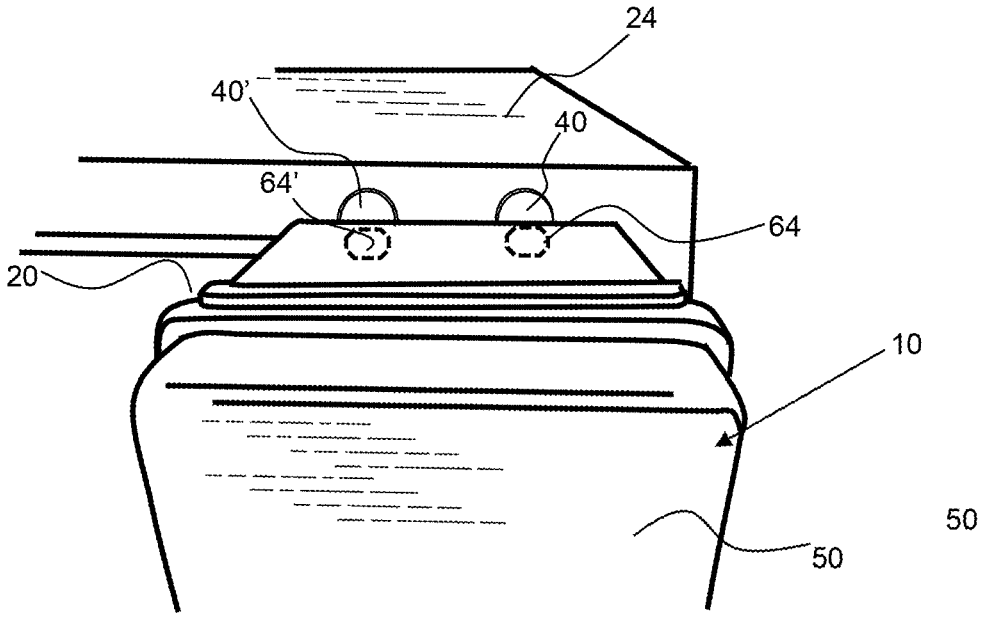
FIG. 5 shows an end of a portion of the chest freezer having a chest freezer plunge power safety system coupled to the chest freezer with the freezer door closed to move the magnet down into proximity of the power system container.
Figure 6:
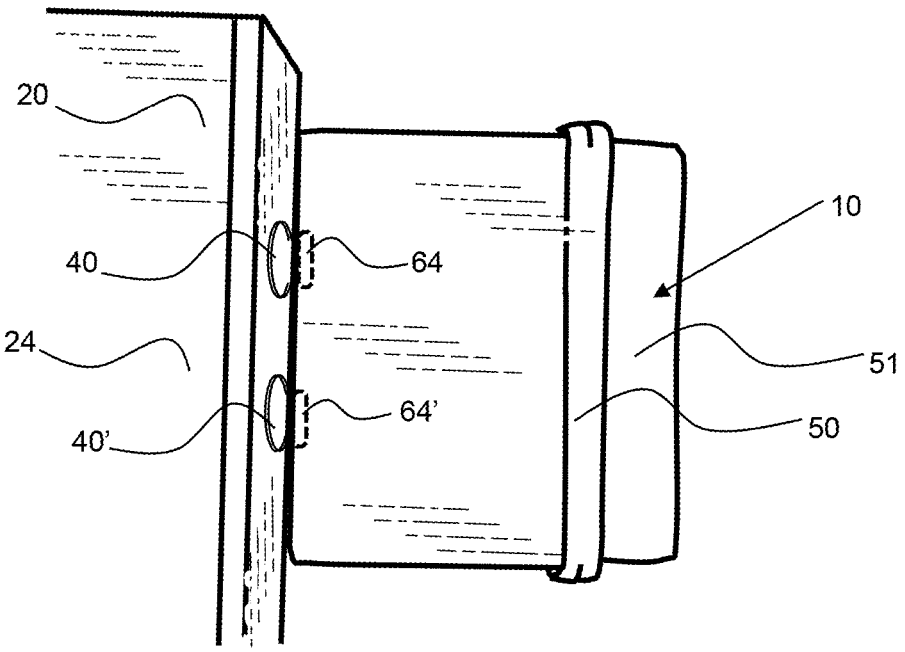
FIG. 6 shows a top view of a chest freezer having a chest freezer plunge power safety system coupled to the chest freezer with the freezer door closed to move the magnet down into proximity of the power system container

As shown in FIGS. 5 and 6 a chest freezer 20 has a chest freezer plunge power safety system coupled to the chest freezer with the freezer door 22 closed to move the magnet 40 down into proximity of the power system container 50.

Figure 7:
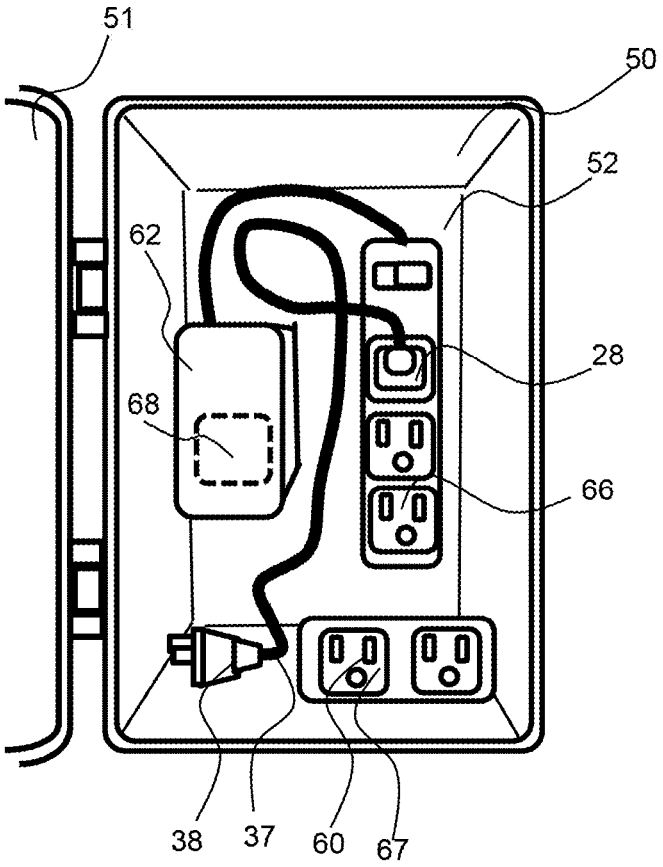
FIG. 7 shows an exemplary power system container with the container cover opened and with components of the chest freezer plunge power safety system shown.
Figure 8:
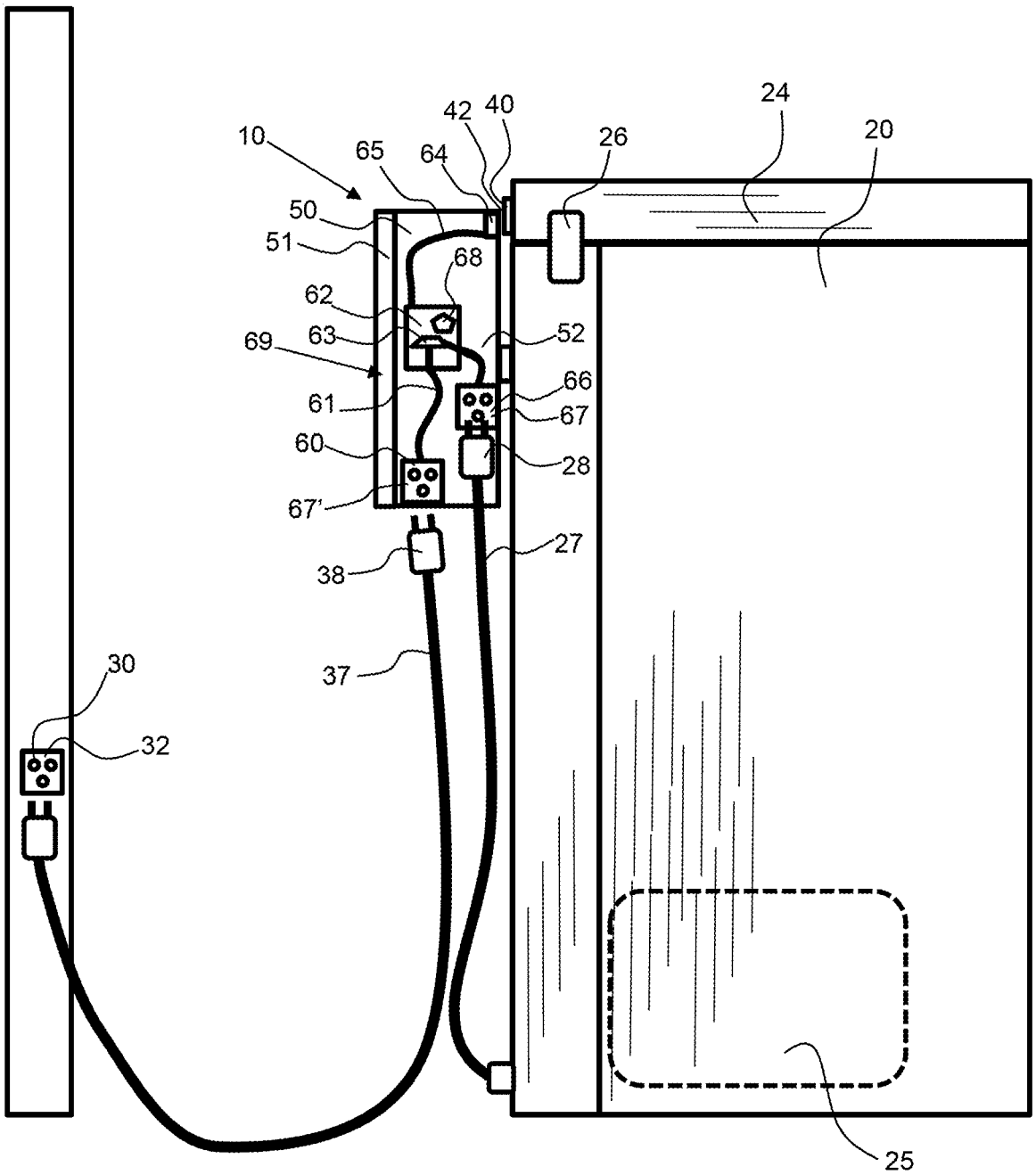
FIG. 8 shows a back view of a chest freezer with a chest freezer plunge power safety system coupled thereto to turn off all electrical power to the freezer when the freezer door is opened.

With reference to FIGS. 7 and 8, an exemplary power system container 50 has the container cover 51 opened to show the power system container interior 52 components of the chest freezer plunge power safety system shown 10. Within the power system container 50 is a contactor 62 having a contactor switch 63 configured to shut off power to a power output 66, an output electrical receptacle 67, when the freezer door 24 is opened to move the magnet 40 away from the sensor 64, as shown in FIG. 8. Electrical power from a power source 30, such as through a power outlet 32 is supplied to the power supply safety system 69 via an input power cable 37 to the power input 60, an input electrical receptacle 67'. The input power plug 38 may be plugged into a power input 60, an input electrical receptacle 67', of the power supply safety system 69. A power input connector 61 may extend from the power input electrical receptacle 67' to the contactor 62. The electrical power supply to the power output 66 is regulated and controlled by the power supply safety system 69, wherein the contactor 62 opens a circuit or contactor switch 63 to prevent any power supply from the power input 60 to the power output 66 when the magnet 40 coupled to the freezer door 24 is not detected by the sensor 64. The sensor 64 is coupled to the contactor by a sensor connector 65, such as a wire, and a controller 68, such as a microprocessor, may control the opening and closing of the contactor switch 63. The chest freezer 20 has a freezer power cable 27 with a freezer power plug 28 that is configured to connect with the power output 66. The freezer power cable 27 provides power to the chest freezer refrigeration. This chest freezer plunge power safety system 10 is configured to prevent any electrical shock by turning off all power to the chest freezer when the freezer door 24 is open.

Figure 9:
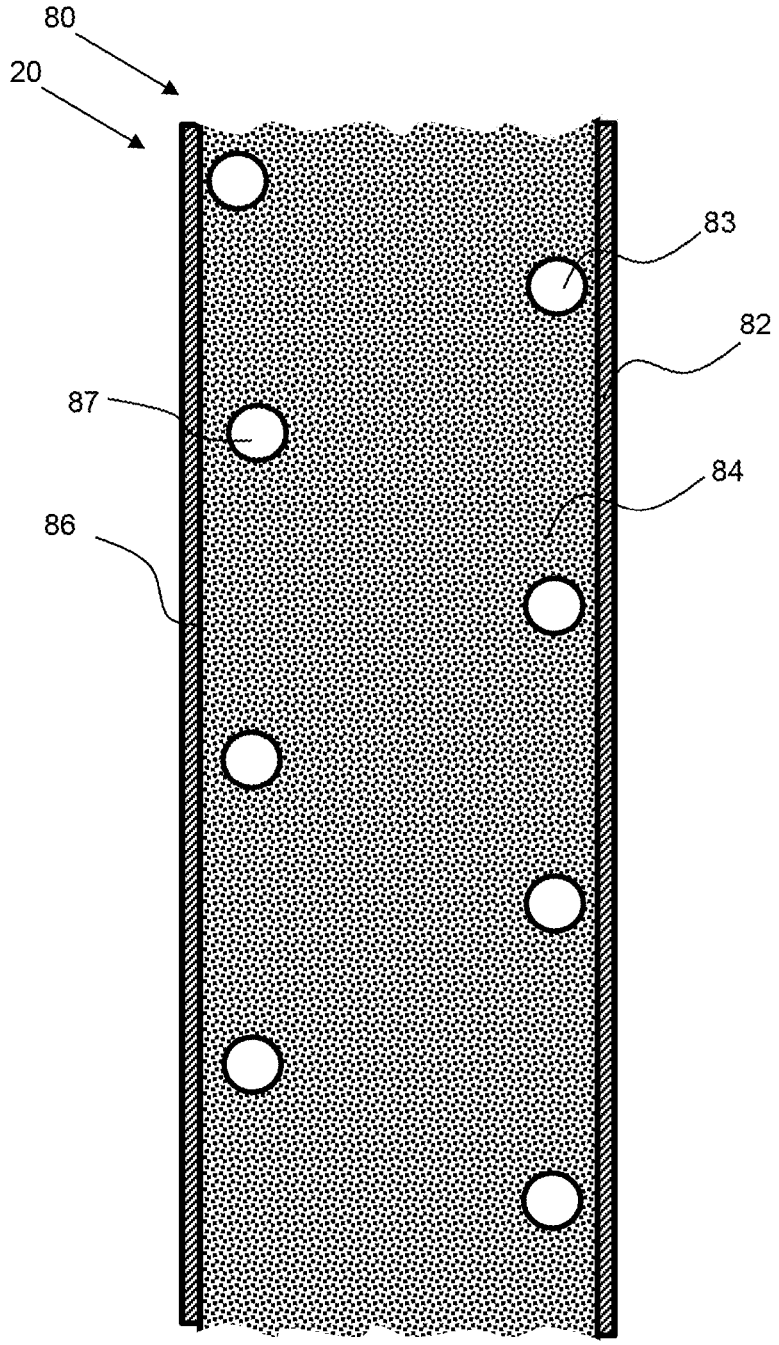
FIG. 9 shows a cross-sectional view of an exemplary chest freezer wall having an evaporator tube and condenser tube extending through the wall.

As shown in FIG. 9, an exemplary chest freezer 20 may be configured to cool the interior or inner wall 82 of the freezer with evaporator tubes 83 that extend within the freezer wall 80 of the chest freezer and proximal to the inner wall. The freezer wall 80 may have the condenser tubes 85 extending proximal to the outer wall 86. Insulation 84 may be configured within the freezer wall or between the inner wall 82 and outer wall 86. Water may be configured within the interior of the freezer and against the inner wall 82 and the water may be cooled by contact with the inner wall.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A chest freezer plunge power safety system comprising:
a) a chest freezer comprising:
i) a freezer receptacle;
ii) a freezer door configured to close over the freezer receptacle;
iii) a freezer power plug; and
iv) a refrigeration system;
b) a sensor element coupled to the freezer door;
c) a power supply safety system comprising:
i) a power system container;
ii) a power input configured to coupled with a power source;
iii) a power output configured to couple with said freezer power plug to provide power to the refrigeration system;
iv) a sensor configured to detect the sensor element;
v) a contactor having a contactor switch configured to turn on and off power from the power input to the power output;
vi) a controller configured to receive input from the sensor and control the contactor switch;
wherein the power output, contactor and controller are configured within the power system container;
wherein the contactor switch is opened to turn off power to the power output when the freezer door is opened to move the sensor element such that the sensor no longer detects the sensor element.

2. The chest freezer plunge power safety system of claim 1, wherein the sensor element is detachably attachable to the freezer door.

3. The chest freezer plunge power safety system of claim 2, wherein the sensor element is a magnet.

4. The chest freezer plunge power safety system of claim 1, wherein the power supply safety system is configured within a power system container.

5. The chest freezer plunge power safety system of claim 1, wherein the power supply container has a container cover configured to allow access into the power system container.

6. The chest freezer plunge power safety system of claim 5, wherein the power source includes a power cable with an input power plug coupled thereto.

7. The chest freezer plunge power safety system of claim 6, wherein the power input is configured on the power supply container to enable the input power plug to couple with the power input without opening the power supply container.

8. The chest freezer plunge power safety system of claim 7, wherein the power input comprises an input electrical receptacle.

9. The chest freezer plunge power safety system of claim 6, wherein the power input comprises an input electrical receptacle.

10. The chest freezer plunge power safety system of claim 9, wherein the input electrical receptacle is configured within the power system container.

11. The chest freezer plunge power safety system of claim 10, wherein the power output comprises an output electrical receptacle.

12. The chest freezer plunge power safety system of claim 11, wherein the output electrical receptacle is configured within the power system container.

13. The chest freezer plunge power safety system of claim 11, wherein the power output is configured on the power supply container to enable the freezer power cable to couple with the power output without opening the power supply container.

14. The chest freezer plunge power safety system of claim 13, wherein the sensor element comprising two sensor elements.

15. The chest freezer plunge power safety system of claim 14, wherein each of the two sensor elements are detected by the sensor to enable power to be connected to the power output from the power source.

16. The chest freezer plunge power safety system of claim 14, wherein the sensor comprising two sensors, wherein a first sensor of the two sensor is configured to detect a first sensor element of the two sensor elements and wherein a second sensor of the two sensors is configured to detect a second sensor element of the two sensor elements to enable power to be connected to the power output from the power source.

17. A chest freezer plunge power safety system comprising:
a) a chest freezer comprising:
i) a freezer receptacle;
ii) a freezer door configured to close over the freezer receptacle;
iii) a freezer power plug; and
iv) a refrigeration system;
b) a sensor element coupled to the freezer door;
wherein the sensor element comprises a magnet;
c) a power supply safety system comprising:
i) a power system container;
ii) a power input configured to coupled with a power source;
iii) a power output configured to couple with said freezer power plug to provide power to the refrigeration system;
iv) a sensor configured to detect the sensor element;
v) a contactor having a contactor switch configured to turn on and off power from the power input to the power output;
vi) a controller configured to receive input from the sensor and control the contactor switch;

wherein the power output, contactor and controller are configured within the power system container;

wherein the contactor switch is opened to turn off power to the power output when the freezer door is opened to move the sensor element such that the sensor no longer detects the sensor element;

wherein the power supply safety system is configured within a power system container having a container cover configured to allow access into the power system container;

wherein the power source includes a power cable with an input power plug coupled thereto;

wherein the power input is configured on the power supply container to enable the input power plug to couple with the power input without opening the power supply container;

wherein the power input comprises an input electrical receptacle;

wherein the input electrical receptacle is configured within the power system container;

wherein the power output comprises an output electrical receptacle;

wherein the output electrical receptacle is configured within the power system container and wherein the power output is configured on the power supple container to enable the freezer power cable to couple with the power output without opening the power supply container.

18. The chest freezer plunge power safety system of claim 17, wherein the sensor element comprising two sensor elements.

19. The chest freezer plunge power safety system of claim 18, wherein each of the two sensor elements are detected by the sensor to enable power to be connected to the power output from the power source.

20. The chest freezer plunge power safety system of claim 18, wherein the sensor comprising two sensors, wherein a first sensor of the two sensor is configured to detect a first sensor element of the two sensor elements and wherein a second sensor of the two sensors is configured to detect a second sensor element of the two sensor elements to enable power to be connected to the power output from the power source.

* * * * *